US007021150B2

(12) United States Patent
Podhorsky

(10) Patent No.: US 7,021,150 B2
(45) Date of Patent: Apr. 4, 2006

(54) DEVICE AND PROCEDURE FOR HYDRAULIC EXPANSION

(75) Inventor: Miroslav Podhorsky, Ratingen (DE)

(73) Assignee: Balcke-Durr GmbH, Ratingen (DE)

( * ) Notice: Subject to any disclaimer, the term of this patent is extended or adjusted under 35 U.S.C. 154(b) by 0 days.

(21) Appl. No.: 11/142,343

(22) Filed: Jun. 2, 2005

(65) Prior Publication Data

US 2006/0000291 A1 Jan. 5, 2006

(30) Foreign Application Priority Data

Jun. 3, 2004 (EP) ..... 04013164

(51) Int. Cl.
*G01L 7/02* (2006.01)
*G01L 7/10* (2006.01)

(52) U.S. Cl. ..... 73/730

(58) Field of Classification Search ..... 73/730, 73/714, 709, 731; 29/726, 727, 523, 890.043, 29/890.044

See application file for complete search history.

(56) References Cited

U.S. PATENT DOCUMENTS 5,301,424 A * 4/1994 Snyder ..... 29/890.044

* cited by examiner

*Primary Examiner*—William Oen
(74) *Attorney, Agent, or Firm*—Baker & Hostetler LLP

(57) ABSTRACT

The invention concerns a hydraulic expansion process for tubes. With this process it is possible to increase the number of hydraulic tube expansions that can be implemented using an expansion device. The hydraulic expansion process in accordance with the invention is highly optimized with regard to control times, pressures and flows. In this process, pressure is produced in the pressure medium with hydraulic oil via a medium separator and a pressure intensifier. In addition, the invention specifies a device for implementing the expansion process and a process for determining the maximum number of hydraulic tube expansions that can be performed with a probe. Finally, the maximum number of expansions is determined taking into account the deformations of the expanded tubes.

18 Claims, 1 Drawing Sheet

DEVICE AND PROCEDURE FOR HYDRAULIC EXPANSION

CROSS REFERENCE TO RELATED APPLICATIONS

This application claims priority to European Patent Application Serial No. 04013164.1, filed Jun. 3, 2004 entitled, DEVICE AND PROCEDURE FOR HYDRAULIC EXPANSION, the disclosure of which is incorporated by reference in its entirety.

FIELD OF THE INVENTION

The invention concerns a hydraulic expansion procedure of a tube against a retaining opening of an adjoining component. In this hydraulic expansion procedure, pressure is produced in the pressure medium with hydraulic oil via a medium separator and a pressure intensifier. The invention also concerns a device for the implementation of this procedure. Furthermore, the invention refers to a process for determining the maximum allowable number of hydraulic tube expansions till the material fatigue of the probe.

BACKGROUND OF THE INVENTION

Processes and devices of this kind are known from e.g., DE 2616523. In the past, these processes and devices have proved to be very suitable, among other things, for fastening heat exchanger tubes in heat exchangers or in the manufacture of camshafts for automobile engines.

Since very high pressure can be developed using hydraulic processes and plants, the individual components that are subject to pressure manifest signs of material fatigue in due course of time. This can endanger the application security of the expansion device. Hence the application of expansion devices is monitored with regular maintenance. The maintenance involves exchanging a multitude of pressurized components depending on predefined maintenance intervals. Thus the maintenance intervals restrict the application of the expansion devices. Due to the great success of these hydraulic plants it is increasingly desired to use the devices for hydraulic expansion more often and/or for longer periods of time than was possible so far.

SUMMARY OF THE INVENTION

Therefore, the task of the invention is to increase the number of hydraulic expansions that can be performed using an expansion device.

This task is solved with the process in accordance with claim 1, the process in accordance with claim 11 and the device in accordance with claim 14. Additional preferred embodiments can be inferred from the subclaims.

The invention refers to a known process for the hydraulic expansion of tubes. This process involves producing pressure in the pressure medium with a hydraulic oil via a medium separator and a pressure intensifier. This known process is characterized by the fact that it uses two different liquids for the expansion that are separated from one another. One liquid is the pressure medium and the other is the hydraulic oil that has a pressure-producing effect on the pressure medium. This process is advantageous particularly in the use of water as a pressure medium in that the expanded tubes do not come into contact with the hydraulic oil and hence do not require laborious cleaning after the completion of the expansion process.

The circuit of the pressure medium and the circuit of the hydraulic oil are separated by using a medium separator and a pressure intensifier, both of which are connected with the two liquid circuits. The medium separator serves for filling the expansion device and/or the pressure intensifier. The pressure intensifier serves for the actual pressure build-up required for the expansion.

Usually the hydraulic expansion process of tubes occurs in the following process steps: feeding a probe, filling the expansion space and the expansion device with the pressure medium, building up pressure in the pressure medium, retaining the expansion pressure for a predetermined expansion time and finally reducing the expansion pressure. In principle, this process flow must be maintained. Tests carried out by the inventor have proved that it is necessary to overwork several process steps in order to solve the task underlying the invention. Accordingly the task of the present invention is solved by the following process:

a) a probe is inserted in a tube member to be expanded. The tube member is surrounded by the retaining opening on the outside. Sealings attached to the probe seal off an expansion space between the tube member to be expanded and the probe;

b) the pressure medium is pressurized in a fill time of at least 1 s and at the most 20 s in the pressure intensifier that is connected to the probe, the probe and the expansion space. The medium separator produces a filling pressure in the pressure medium that amounts to 1.3 to 1.5 times, preferably 1.4 times the hydraulic oil pressure;

c) an expansion pressure is built up in the pressure medium in a pressure build-up time of at least 1 s and at the most 20 s. The expansion pressure in the pressure medium is increased by the pressure intensifier to 13 to 15 times, preferably 14 times the hydraulic oil pressure.

d) The expansion pressure in the pressure medium is maintained for a predetermined expansion time of at least 1 s and at the most 10 s;

e) The expansion pressure is reduced automatically at the end of the expansion time.

The solution of the task underlying the present invention comprises an interaction of a large number of varying process parameters that achieve different synergy effects in complex combinations. Therefore for simplification only the individual effects of the process steps are presented in the following description.

By restricting the fill time to a timeframe that is confined to these lower and upper limits, the elastic sealings on the probe can be well adjusted to the stresses occurring in this process step. This reduces the deformation rate thus leading to reduced signs of material fatigue on the sealings. The filling with pressure medium contains the filling of the expansion space, the probe and all the pressure lines and devices that are connected to the probe such as e.g., the pressure intensifier. Moreover, the filling period is so limited that it ensures a response time that is sufficiently large for the pumps and pistons of the expansion device. However, at the same time, the filling period optimizes the operations flow with a short maximum time. Additionally, an exceedance of the maximum time suggests that e.g., there is some leakage and hence the sealings or the probe must be inspected.

Limiting the pressure build-up time to a maximum time results in an equalized generation of the expansion pressure in the device in an economic mode of operation. As a result of the minimum pressure build-up time together with the minimum expansion pressure, again the time for transmission of pressure into the sealings is sufficiently large in order to increase their stableness. Thus the sealings are not explosively loaded.

Thus the timeframe of 1 s to a maximum of 20 s represents both during the filling as well as during the pressure build-up, the optimum compromise between a preferred high speed of process implementation and a slower pressure transmission that is desirable for a lasting process flow. Due to this compromise, the sealings attached to the probe have clearly greater stability during a fast fill time and pressure build-up time.

In addition, research has shown that particularly increasing the expansion pressure to 13 to 15 times, preferably 14 times the hydraulic pressure by the pressure intensifier in the interaction with the limited timeframes for filling the expansion space and the probe represents a particularly favorable proportional value. This combination once again reduces the signs of wear in the sealings and in the probe with better efficiency as compared to what can be expected using individual measures. A filling pressure amounting to 1.4 times the hydraulic oil pressure as opposed to an expansion pressure amounting to 14 times the hydraulic oil pressure proved to be ideal.

Furthermore, the expansion pressure is maintained for an expansion time of 1 s to maximum 10 s. Under the effect of the expansion pressure the tube begins to get deformed plastically. The tube material 'flows' since it experiences a large and lasting deformation. The tube deformations are controlled via the time and not via the pressure application. This is achieved by selecting the expansion time depending on the tube materials, the geometry of the retaining opening and the stiffness and/or geometry of the adjoining component. Limiting the timeframe also results in a deformation behavior that corresponds to the usual dimensions and materials. The sealings have just sufficient time in order to be able to follow the plastic deformations of the tube member to be expanded. In this connection the minimum limit of 1 s is a value that is required essentially so that commonly used materials deform plastically to a sufficient degree.

Finally the automatic reduction of the expansion pressure at the end of the expansion time enables the immediate relief of load on the probe and also on the probe sealings. Thus it is possible to avoid unnecessary loads, if the desired results have been achieved and this clearly increases the life span of these components.

All in all, during the expansion of an individual tube, this results in a slower process flow that is compensated for by an increased number of expansions that are performed using the same expansion plant. Thus it is possible to implement the expansion operation of several tubes faster and more economically.

In an advantageous embodiment of the process, an expansion pressure of 2000 bar to 4000 bar is produced. This pressure range has proved to be particularly suitable for expanding tubes of all prevalent materials from the point of view of the stability of the expansion devices.

If tubes that are shrink-wrapped beforehand into a tube plate are expanded hydraulically, then in a preferred embodiment of the process the probe is arranged at a distance from the heat-sealed edge of the tube plate, whereby the distance amounts to 1.0 to 1.5 times the inner diameter of the tube to be expanded.

Furthermore, a deformation appearing in the tube is preferably measured during the expansion. This deformation measurement of the tube taken during the expansion can be used for optimizing the pressure feed in order to protect the devices used for implementing the process such as e.g., the probe and the sealings from unnecessary or excessive loading.

Apart from that, it is preferred to determine the deformation appearing in the tube from a pressure drop in the pressure medium and/or in the hydraulic oil. Thus the deformation can be measured indirectly with known properties of the pressure medium and/or the hydraulic oil. For this purpose e.g., the plastic deformation behavior can be measured using measurement techniques since the material behavior changes essentially while achieving the so-called flow limit (liquid limit). Till the flow rate is reached, e.g., steel has an approximately linear correlation of stress and strain while after that, large deformations appear without further pressure increase. If a steel tube flows, it stretches out suddenly under the prevailing pressure. This effect is now used for recording the deformation behavior using measurement techniques. Thus the pressure medium that is subject to pressure can be relieved of stress easily and all of a sudden due to the tube cross-section that has quickly become larger. This leads to a short-term pressure reduction that can be determined by using measurement techniques such as e.g., a pressure fluctuation or also the drive capacity of the hydraulic system. Thus it is possible to measure the developing deformations immediately during the expansion.

It is preferred to execute the process in such a way that the expansion pressure and/or the expansion time are selected depending on the deformation appearing in the tube. Thus the expansion parameters are coupled with the actually appearing deformation so as to enable an optimization of expansion pressure and expansion time such that they produce the exact desired deformation.

The process is preferably implemented with the help of a control system whereby the control system maintains a constant expansion pressure during the expansion time. This means that in this embodiment of the process, via a suitable control system such as e.g., a computer with storage medium and processing unit, the expansion pressure is determined by the control system using suitable measuring devices such as e.g., high pressure transducers. If during the expansion process, there are intensified volume changes in the expansion space, the rate of the process can be adjusted by the control system with the help of a drive organ such as e.g., a hydraulic pump. This equalizes the pressure drop that developed due to the yielding (flowing) and optimizes and/or accelerates the expansion process once again.

In another embodiment of the process in accordance with the invention, the control system is fed with at least the geometry of the tube to be expanded, the geometry of the retaining opening in the adjoining component and a predetermined tube retention force. The control system determines the expansion pressure required for reaching this tube retention force and the expansion time. This means, that the retention force to be reached, that is the force with which the tube must be held in the retaining opening, is provided to the control system as the target value. Using this and together with the specifications regarding the geometry of the tube to be expanded, the control system can automatically calculate the parameters of the expansion pressure and expansion time necessary for achieving the target.

The diameter and the thickness of the tube wall and also the hole diameter of the retaining opening should be fed to the control system. Specifications regarding the materials of the tube to be expanded and/or of the adjoining component are necessary only if e.g., materials other than the conventional ones or a series of different materials are used. Then the control system would be fed with the specifications regarding the material properties of these materials, such as e.g., the E-module. If the same materials are to be used always, the material values are provided to the control system in a practical and convenient manner in a material database. The control system can then determine the required expansion pressure for the achievement of the expansion using the geometric and material values.

It is particularly advantageous if in order to ascertain the required expansion pressure and the expansion time, the control system determines the material properties of the tube and if necessary also of the adjoining component automatically using a deformation measurement. By recording the deformation behavior depending on the applied pressure, the control system can either recognize the basic materials used in the expansion process by comparing the measured values from the deformation measurement with a material database or it can automatically calculate own material laws. This provides for the highest precision in the application of expansion pressures and expansion times and considerably reduces the loading of the probe and sealing components. Thus the number of expansion operations increases, which can be performed using one expansion device.

In another embodiment of the present invention, the control system determines the degree of wear of the probe. The degree of wear is the result of the number of expansions that are actually performed using the probe. However, the control system can also record the stresses that have actually developed in the probe as a degree of wear. The stresses can be determined e.g., from the applied pressures in the hydraulic system. The degree of wear enables an evaluation of the state of the probe, with which the number of expansions and/or the duration of the use of the probe can be ideally adjusted to its durability. This results in clearly higher numbers of application and/or expansion that can be performed with one probe.

The task underlying the present invention is also solved by a process for determining a maximum number of hydraulic tube expansions that can be performed with one probe. The maximum number of expansions is determined taking into account the tube deformations of the expanded tube. It is thus a process to predict the stability of the probe in which the load of the probe is determined indirectly via the deformations of the tube expanded by it and not from the direct load of the probe. The advantage of this process is that the deformations of the expanded tube can be measured essentially more easily than by loading the probe itself with stress. On the other hand, depending on the used sealings, there is a direct correlation between the tube deformation and the load of the probe. An upper limit for the loading capacity of the probe can be determined from this correlation.

It is preferable to determine the maximum number of the possible expansions with defined tube deformations before the expansion operations are carried out. This means that the maximum possible number of the expansions that can be performed using the probe is determined on the basis of the desired tube deformations and as far as possible even before one expansion operation is carried out using the probe. Thus the operating conditions of the probe and consequently its lifespan are determined concretely. In this way the user of the probe can be informed even before the initial operation of the probe, how often he may use the probe under these conditions. This provides a very accurate estimated value of the probe. Using this value an upper limit for the load capacity of the probe can be determined.

In another embodiment of the present invention, the tube deformations appearing in the tube are measured after the implementation of at least one, preferably every expansion and using this measurement a maximum number of possible expansions is determined. Thus after every expansion and using the actually achieved tube deformation, it is possible to determine how many expansions are still possible using the expansion device. Thus it is possible to implement varying operating conditions and/or variably strong expansions using the expansion device with the optimized accuracy of the stability prognosis.

In addition, this process in accordance with the present invention can also be implemented starting from the stability prognosis that is based on defined tube deformations. Then in case of a deviation from the defined tube deformations, a corrected maximum number is determined taking into account the tube deformations that have been actually produced using the probe. Starting from a first theoretical estimated value, it is possible to arrive at a prognosis that improves steadily after each expansion, for the maximum allowable number of expansions.

All in all, in both the configurations of the process for the stability prognosis, the usual safety factors in the determination of maximum allowable pressure expansions can be reduced due to the improved accuracy of prognosis. This results in a further clear increase in the number of expansions that can be carried out using the probe. At the same time, the improved prognosis provides an increased safety to the user since the actual degree of loading of the probe is determined more accurately.

The task is solved also using a device for implementing these processes. The device has a medium separator, a pressure intensifier and a probe with sealings. Pressure is produced in the pressure medium via the medium separator and the pressure intensifier using a hydraulic oil. The basic material of the probe is 34 CrNiMo 6. In tests, this special material has proved to be particularly pressure-resistant, permanently loadable and corrosion-resistant.

In another configuration of the present invention, the sealings on the probe consist of a sealing material with the hardness of 90 shore A. Gummy materials of this hardness have a good elastic deformability, high stability and excellent sealing properties.

Furthermore, the hydraulic oil should correspond to the DIN 51524 part 2. This guarantees a particularly high measure of operational safety and cost-effectiveness of the hydraulic expansion device that, as tests have shown, depend to a great degree on the quality of the hydraulic oil used. Thus the hydraulic oil assumes the task of an energy source while it reliably lubricates all the inner parts of the expansion device that move against each other. At the same time, a hydraulic oil of such kind does not attack the aforementioned sealing elements, does not foam due to the working pressures present, has good age-resistance properties and provides good protection from corrosion. Finally, a hydraulic oil of this kind also has a favorable viscosity-temperature ratio, that is, the temperature differences appearing in the oil during the expansion operation do not cause any far too large viscosity changes.

Moreover, the hydraulic oil is filtered and/or cooled whereby the maximum oil temperature is preferably restricted to 40° C. to 50° C. Concretely the hydraulic oil should meet the purity level 16/12 which complies to norm ISO 4406. The cooling prevents the hydraulic oil from heating up unreliably, whereby preferably an air-cooled oil cooler is used that switches on at 50° C. and off at 40° C.

It is particularly preferable to use desalted water in the device as the pressure medium. This does not attack the expanded tubes and the tubes then do not need to be cleaned after the hydraulic expansion.

BRIEF DESCRIPTION OF THE DRAWINGS

The present invention will become more clearly understood from the following detailed description when considered in connection with the accompanying drawings in which the following is illustrated schematically.

DETAILED DESCRIPTION

Figure 1:
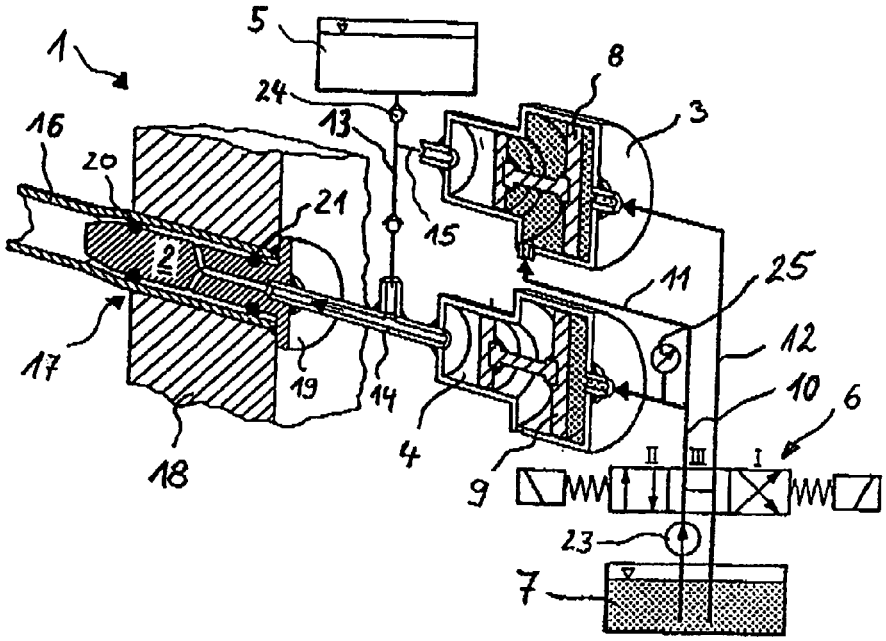
FIG. 1 a spatial sectional view of a hydraulic expansion device with a probe in accordance with a first embodiment.

The expansion device 1 illustrated in FIG. 1 has a probe 2, a medium separator 3, a pressure intensifier 4, a water tank 5, a switch valve 6 and an oil tank 7. A displaceable medium separator piston 8 is located in the medium separator 3. A displaceable pressure intensifier piston 9 is present in the pressure intensifier. The pressure intensifier 4 is connected with the hydraulic oil tank 7 via a hydraulic line 10. The medium separator 3 is connected via a hydraulic line 11 that branches off from the hydraulic line 10 and a hydraulic line 12 with the oil tank 7. From the water tank 5 a pressure water line 13 leads to the probe line 14. A pressure water line 15 branches off from the probe line 14 and leads to the medium separator 15.

In the first step of the process for the hydraulic expansion of a tube 16 in a retaining opening 17 of an adjoining tube plate 18, the probe 2 is inserted in the tube. In the first embodiment of the probe 2 illustrated in FIG. 1, a circular stop 19 projecting over the diameter of the tube 16 ensures that the sealings 20 and 21 of the probe are located inside the retaining opening 17. The stop 19 also ensures that the expansion of the tube takes place only in the area of the retaining opening 17. Additionally, the distance between the stop 19 and the rear probe sealing 21 equals 1.0 times the diameter of the tube to be expanded, because here the tube to be expanded 16 is already shrink-wrapped into the tube plate 18 for sealing with a sealed welded seam 22.

After inserting and adjusting the probe 2 water is pumped by it into the expansion space such that first the hydraulic switch valve 6 is brought into a first position I. Then hydraulic oil from the pump 23 is pumped through the hydraulic line 12 into the medium separator 3. This hydraulic oil presses the medium separator piston 8 against the water, which had previously streamed from the water tank 5 into the medium separator 3, via the pressure water line 15 into the pressure water line 13, whereby a check valve 24 prevents the water from flowing back into the water tank 5. Water is pumped into the probe line 14 and flows from there through the probe 2 into the expansion space lying between the two sealings 20 and 21 and the tube wall as well as the probe. At the same time water also flows into the pressure intensifier 4. The ratio of the piston and the medium separator 3 of 1:1.4 leads to a water pressure that increases 1.4 times the hydraulic oil pressure. This ensures a speedy filing of the expansion space of the probe and of the pressure intensifier.

As the next step of the process, the switch valve 6 is brought into position II, so that the oil pump 23 pumps the hydraulic oil into the pressure intensifier 4 and simultaneously via the hydraulic line 11 causes the medium separator piston 8 to reset. Thus hydraulic oil is pumped simultaneously into the pressure intensifier 4 and pressed out of the medium separator 3 and new water is sucked into the medium separator 3. The pressing in of hydraulic oil in the pressure intensifier 4 pressurizes the water in the pressure intensifier 4 as well as the expansion space connected with it. The ratio of the piston and the pressure intensifier 4 of 1:14 increases the water pressure 14 times the hydraulic oil pressure. During this process the hydraulic oil pressure can be read off from a manometer 25. If the desired pressure has been attained in the hydraulic oil, the expansion pressure in the expansion space increases 14 times accordingly. This is maintained for a definite expansion time. At the end of the expansion time and/or achievement of the desired tube deformation, the switch valve 6 is brought into a third position. This is the no-load operation in which the probe 2, the medium separator 3 and the pressure intensifier 4 are relieved of load. At the same time the oil pump 23 is switched off so that the water can push back the pressure intensifier piston 9 since the water can flow only into the pressure intensifier 4 due to the check valve 26. At the end of the expansion process the probe 2 can be extracted from the expanded tube 16, the residual water then flows out and the expansion device 1 is again available for another expansion process.

Figure 2:
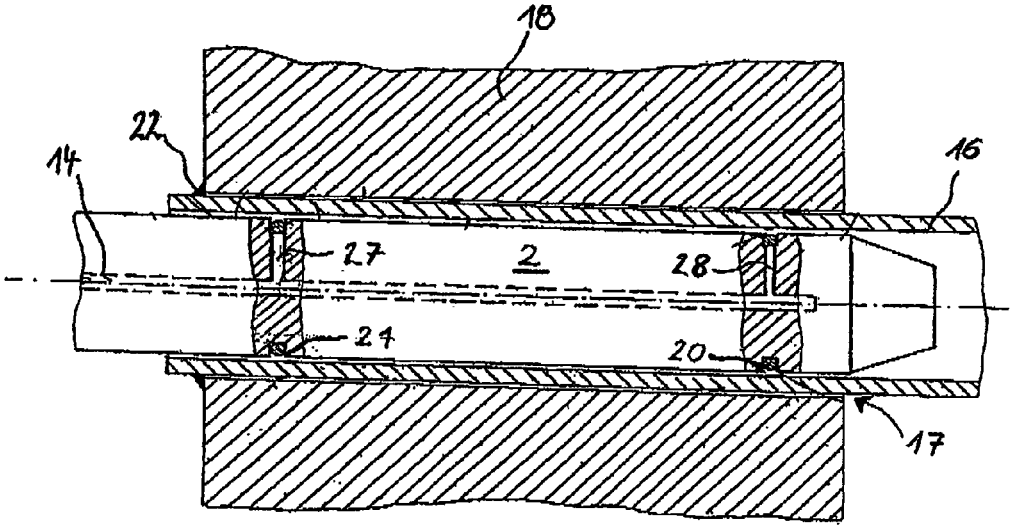
FIG. 2 a longitudinal section of a probe inserted into a tube to be expanded in accordance with a second embodiment.

In FIG. 2 a second embodiment of the probe 2 is illustrated that has two inflow lines 27 and 28 that are each connected with the probe line 14. A sealing ring 20 and/or 21 rests on these two inflow lines 27, 28 in an annular recess 29.

The advantage of this embodiment of the probe is that the filling of the expansion space between the two sealings 20, 21 takes place in such a manner that the water is pumped through the probe line 14 and the inflow lines 27 and 28 connected to it. The water presses the sealing rings 20 and 21 against the wall of the tube 16. This means that the sealing rings do not project over the surface of the probe 2 during the insertion. Therefore the probe 2 can be inserted easily. Only during the filling of the expansion space with water, the sealings 20, 21 are stretched out by the water flowing out and are thus placed on the tube 16 for sealing. This minimizes the abrasion of the sealings 20, 21 during the insertion into the tube 16 and thus increases the number of expansions that can be performed using them.

What is claimed is:

1. Process for the hydraulic expansion of a tube against a retaining opening of an adjoining component, in which pressure is produced in the pressure medium with a hydraulic oil via a media separator and a pressure intensifier comprising:

a) a probe inserted into a tube member to be expanded wherein the tube member is surrounded on the outside by a retaining opening; a sealings attached to the probe that seals off an expansion space between the tube member to be expanded and the probe;

b) wherein the pressure medium is pressurized in a fill time of at least 1 s and at the most 20 s in the pressure intensifier that is connected to the probe, the probe (2) and the expansion space, and wherein the medium separator produces a filling pressure in the pressure medium that amounts to 1.3 to 1.5 times, preferably 1.4 times the hydraulic pressure;

c) and wherein an expansion pressure is built-up in the pressure medium in a pressure build-up time of at least 1 s and at the most 20 s, whereby the expansion pressure in the pressure medium is increased by the pressure intensifier to 13 to 15 times, preferably 14 times the hydraulic pressure;

d) wherein the expansion pressure in the pressure medium is maintained for a predetermined expansion time of at least 1 s and at the most 10 s; and e) wherein the expansion pressure is reduced automatically at the end of the expansion time.

2. Process in accordance with claim 1, wherein an expansion pressure of 2000 bar to 4000 bar is produced.

3. Process in accordance with claim 1 wherein the expansion of a tube is shrink-wrapped beforehand inside a tube plate, and wherein the probe is arranged at a distance from a heat-sealed edge of the tube plate such that the distance amounts to 1.0 to 1.5 times the inner diameter of the tube to be expanded.

4. Process in accordance with claim 1 wherein at least one deformation that appears in the tube during the expansion process is measured.

5. Process in accordance with claim 4 wherein the deformation that appears in the tube is due to a pressure drop in the pressure medium and/or in the hydraulic oil.

6. Process in accordance with claim 1 wherein the expansion pressure and/or the expansion time can be selected depending on the deformation that appears in the tube.

7. Process in accordance with claim 1 wherein the fact that a control system keeps the expansion pressure at a constant level during the expansion time.

8. Process in accordance with claim 1 wherein the control system is fed at least with the geometry of the tube to be expanded and of the retaining opening in the adjoining component and a predetermined tube retention force and wherein the control system determines the expansion pressure required to achieve this retention force and the expansion time.

9. Process in accordance with claim 1 wherein in order to determine the required expansion pressure and the expansion time, the control system independently ascertains the material properties of the tube and if necessary, also of the adjoining component from the deformation measurement.

10. Process in accordance with claim 1 wherein the control system determines the degree of wear of the probe.

11. Process for determining the maximum number of hydraulic tube expansions that can be performed with a probe wherein the maximum number of expansions is determined taking into account the deformations of the expanded tube.

12. Process in accordance with claim 11 wherein before performing the expansion operations the maximum number of the possible expansions with defined tube deformations is determined.

13. Process in accordance with claim 11 wherein the tube deformations are measured after the performance of at least one, and preferably every expansion operation and a maximum number of the possible expansions is determined using that measurement.

14. Device for the implementation of a process in accordance with claim 1 comprising a medium separator, a pressure intensifier and a probe with sealings whereby pressure is produced in the pressure medium via the medium separator and the pressure intensifier with a hydraulic oil and wherein the device for the implementation of this expansion process is characterized by the fact that the basic material of the probe is 34 CrNiMo 6.

15. Device in accordance with claim 14 wherein the sealings on the probe comprise a sealing material with the hardness of 90 Shore A.

16. Device in accordance with claim 1 wherein the hydraulic oil complies with the norm DIN 51524 part 2.

17. Device in accordance with claim 1 wherein the hydraulic oil is filtered and/or cooled whereby the maximum oil temperature is preferably restricted to 40° C. to 50° C.

18. Device in accordance with claim 1 wherein the desalted water is used as the pressure medium.

* * * * *